United States Patent [19]

McWilliams

[11] Patent Number: 4,508,961

[45] **Date of Patent: * Apr. 2, 1985**

[54] ELECTRIC RADIANT HEATER UNITS FOR GLASS CERAMIC TOP COOKERS

[75] Inventor: Joseph A. McWilliams, Droitwich, England

[73] Assignee: Micropore International Limited, Droitwich, England

[ * ] Notice: The portion of the term of this patent subsequent to Apr. 20, 1999 has been disclaimed.

[21] Appl. No.: 470,294

[22] Filed: Feb. 28, 1983

[30] Foreign Application Priority Data

Mar. 2, 1982 [GB] United Kingdom ..... 8206043

[51] Int. Cl.[3] ..... H05B 3/68

[52] U.S. Cl. ..... 219/449; 219/446; 219/460; 219/464; 219/466; 219/512; 337/394

[58] Field of Search ..... 219/441, 442, 443, 445, 219/446, 448, 449, 452, 459, 460, 461, 462, 463, 464, 465, 466, 467, 510, 512; 337/392, 394

[56] References Cited

U.S. PATENT DOCUMENTS

| | | | |
|---|---|---|---|
| 2,152,560 | 3/1939 | Myers | 219/213 |
| 3,710,076 | 1/1973 | Frazier | 219/449 |
| 4,243,874 | 1/1981 | Fischer | 219/467 |
| 4,327,280 | 4/1982 | McWilliams | 219/464 |
| 4,350,875 | 9/1982 | McWilliams | 219/449 |
| 4,371,780 | 2/1983 | Gössler et al. | 219/446 |
| 4,393,299 | 7/1983 | McWilliams | 219/446 |
| 4,430,558 | 2/1984 | McWilliams | 219/449 |
| 4,447,710 | 5/1984 | McWilliams | 219/449 |

*Primary Examiner*—Volodymyr Y. Mayewsky

[57] ABSTRACT

An electric radiant heater unit of the kind used in glass ceramic top cookers comprises first and second heater elements disposed adjacent to each other on a base layer of thermal and electrical insulating material, the arrangement being such that, in use, the heat emitted by the second heater element augments the heat emitted by the first heater element. A peripheral wall of thermal insulating material surrounds the heater elements and a thermal cut-out device extends over both of the heater elements. There is also provided means such as a block of thermal insulating material or a heat sink for shielding the thermal cut-out device in the regions thereof which pass over the second heater element from heat emitted by both the first and second heater elements.

11 Claims, 5 Drawing Figures

ELECTRIC RADIANT HEATER UNITS FOR GLASS CERAMIC TOP COOKERS

FIELD OF THE INVENTION

The present invention relates to electric radiant heater units of the kind used in glass ceramic top cookers.

BACKGROUND OF THE INVENTION

Electric cookers supply heat to utensils placed on their heater units by means of heat transmitted to the utensil by convection, conduction and radiation. Of these, conduction and radiation are dominant radiant heat from the heater unit passing directly to the utensil and heat being conducted to the utensil by contact of the utensil with the heater unit. The amount of heat conducted to the utensil is dependent, of course, on the degree of contact between the utensil and the heater unit. In the case of a glass ceramic top cooker, the contact is with the smooth glass ceramic plate which is heated by the heater unit.

A glass ceramic top cooker is one in which a smooth plate of glass ceramic overlies one or more generally circular electric heater elements supported on a layer of thermal and electrical insulating material such that the or each heater element is spaced from the underside of the glass ceramic plate. In use, a utensil placed on the glass ceramic plate above a heater element is heated by the transmission of heat from the heater element to and through the glass ceramic plate by air convection, conduction and infra-red radiation. Such heater elements are referred to as radiant heaters. The insulating material substantially prevents heat being transmitted away from the heater elements except towards the glass ceramic plate and, because the preferred materials for the plate are essentially thermally non-conductive, only areas of the plate which are directly exposed to the heater element will be heated. In order to prevent heat being transmitted to parts of the glass ceramic plate not covered by a utensil placed directly above a heater element, a peripheral wall of thermal insulating material is also normally provided around the heater element.

In addition, a thermal cut-out device extends above the heater element in order to protect both the heater element and the glass ceramic plate against overheating. The thermal cut-out device comprises a differential expansion probe which extends above the heating element and a snap-acting switch located outside the peripheral wall so as to disconnect the heating element from its electrical supply in order to prevent excessive temperatures which can be hazardous to the user and can cause damage to or discolouration of the glass ceramic cooking surface.

DESCRIPTION OF PRIOR ART

Manufacturers of glass ceramic top cookers constantly wish to improve the performance of their products, which performance can be determined by measuring the time taken to bring to the boil a predetermined volume of water at a predetermined initial temperature. One way which has been proposed to improve performance is to increase the watts rating of the heating element, for example from 1000 watts to 1100 watts or from 1500 watts to 1600 watts for a given diameter of heater, but this proposal is ineffective because it merely causes the thermal cut-out device to disconnect the heating element more frequently. It has also been proposed, for a given diameter of heater, to provide a secondary heating element, rated at, say, 450 to 500 watts, around the primary heater element, the secondary heating element being energised only at certain settings of the control switch for the heater. However, such a secondary heating element has a deleterious effect on the operation of the thermal cut-out device which actually causes the cut-out device to disconnect the heating elements at a lower temperature of the cooking surface and which leads to poorer performance despite the higher watts rating. British Patent Application No. 2,069,300 A also discloses a heater having two heating elements, but the heater is designed to define separate and distinct heating zones on the glass ceramic cooking surface for use with different sizes of utensil, the heating elements for this purpose being separated by a dividing wall. This heater, therefore, although it is more versatile, does not demonstrate an improved heating performance.

OBJECT OF THE INVENTION

It is an object of the present invention to provide a radiant heater incorporating primary and secondary heating elements and which gives a better performance than has hitherto been possible.

SUMMARY OF THE INVENTION

According to the present invention there is provided an electric radiant heater unit for a glass ceramic top cooker, the heater unit comprising:

- a base layer of thermal and electrical insulating material;
- first and second heater elements disposed adjacent to each other on the base layer and arranged such that, in use, the heat emitted by said second heater element augments the heat emitted by said first heater element;
- a peripheral wall of thermal insulating material surrounding said heater elements;
- a thermal cut-out device extending over said first and second heater elements; and
- means for shielding the thermal cut-out device in the regions thereof which pass over the second heater element from heat emitted by both said first and second heater elements.

The shielding means may comprise a block of thermal insulating material such as ceramic fibre or a microporous insulation material. A groove may be formed in the block so as to facilitate the passage of the thermal cut-out device.

Alternatively, the shielding means may comprise a heat sink which absorbs heat emitted by the heater elements in the region of the second heater element and which conducts the heat outside the heater unit.

In one embodiment of the present invention, the second heater element may extend substantially entirely around the first heater element so as to be positioned between the first heater element and the peripheral wall. In such an arrangement, where the shielding means comprises a block of thermal insulating material, such a block is preferably arranged at each end of the thermal cut-out device. The blocks may extend into cut-away portions of the peripheral wall. However, where the shielding means comprises a heat sink, a copper tube may be arranged at each end of the thermal cut-out device, the copper tube being connected to a metal dish which contains the base layer and the peripheral wall.

For a heater unit having a nominal heated diameter of 145 mm, the first heater element may be rated at 1000 watts and the second heater element may be rated at 450 watts. Alternatively, for a heater unit having a nominal heated diameter of 180 mm, the first heater element may be rated at 1500 watts and the second heater element may be rated at 500 watts.

For a better understanding of the present invention and to show more clearly how it may be carried into effect reference will now be made, by way of example, to the accompanying drawings in which:

DESCRIPTION OF PREFERRED EMBODIMENTS

Figure 1:
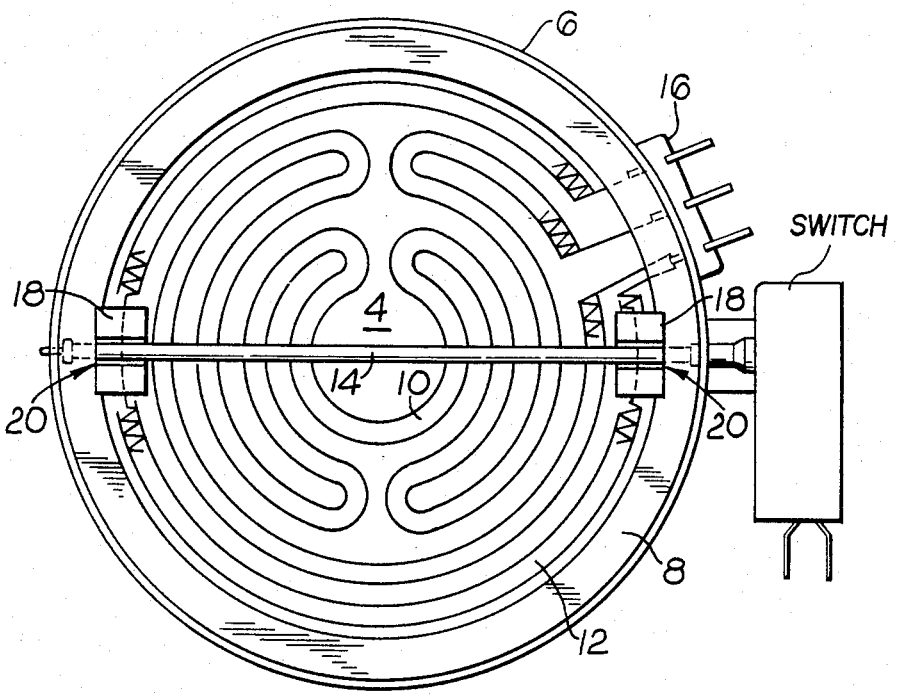
FIG. 1 is a plan view of one embodiment of a radiant heater unit according to the present invention.

The same reference numerals are used in all the Figures to denote similar parts.

Figure 2:
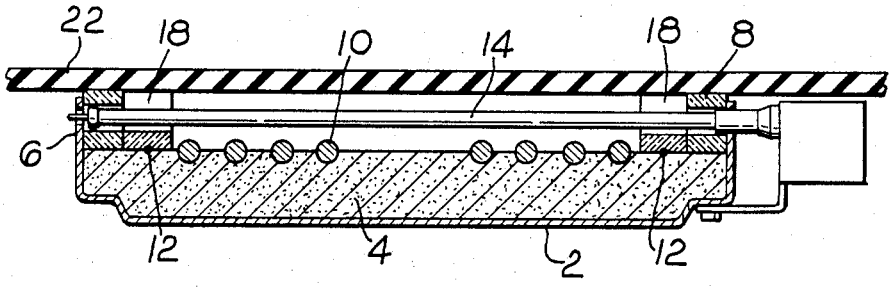
FIG. 2 is a sectional view showing the radiant heater unit of FIG. 1 arranged beneath the glass ceramic plate of a cooker.

FIGS. 1 and 2 show a radiant heater unit which comprises a metal dish 2 containing a base layer 4 of electrical and thermal insulating material. The metal dish 2 is formed with a side 6 against which is located a peripheral wall 8 of thermal insulating material. Set in grooves formed in the base layer 4 are two substantially concentric electric heater elements 10 and 12. Extending over the heater elements is a thermal cutout device 14 which is operable to disconnect both heater elements from their electrical supply (not shown) in the event of overheating.

Each heater element is controlled independently by way of a terminal connector which enables the inner heater element 10 alone to be energised by an energy regulator (not shown) for a predetermined number of settings of the regulator and which enables both heater elements 10 and 12 to be energised for at least one further setting of the energy regulator. Each heater element is in the form of an unprotected coil and is secured to the base layer 4 by means of staples (not shown). The coils are made from a resistance heating wire which may be composed, for example, of an iron-chromium-aluminium alloy or an iron-chromium-aluminium-yttrium alloy.

As shown in FIGS. 1 and 2, a block 18 of insulating material is positioned around the stem of the thermal cut-out device 14 in the diametrically opposed regions in which the cut-out device passes over the outer heater element 12. The blocks 18 shield the cut-out device from the thermal influence of both the inner and outer heater elements. As shown in FIGS. 1 and 2, the blocks 18 may be formed with a groove 20 which accommodates the stem of the cut-out device 14 and they may also be set partly into the peripheral wall 8 for reinforcement purposes. Ideally, the blocks 18 protrude radially inwardly to a point between the outer heater element 12 and the outermost arc of the inner heater element 10. Typically, the blocks 18 may extend radially inwardly from the peripheral wall by a distance of about 7.5 mm and may have a width of about 20 mm. The windings of the outer heater element 12 are straightened where they pass beneath the blocks 18. The height of the blocks is such as to reach substantially the same level as the peripheral wall 8 so that the wall and the blocks may both bear against the underside of the glass ceramic plate 22 when the heater unit is installed in a cooker. The material forming the blocks may be, for example, ceramic fibre or a microporous insulation material. The material forming the base layer 4 is preferably a microporous insulation material, whereas the material forming the peripheral wall 8 is preferably ceramic fibre.

The heater unit illustrated in FIGS. 1 and 2 may have a nominal heated diameter of 145 mm. Such a heater unit typically has a heater element rated at 1000 watts and in the illustrated embodiment the inner heater element is confined to the four inner arcs and is rated at 1000 watts, whereas the outer heater element is located in the outermost arc and is rated at 450 watts.

It has been found that such a heater unit, in the absence of the blocks 18 has a performance considerably poorer than a conventional 1000 watt unit, whereas a heater unit as described above has a performance superior to a conventional 1000 watt unit. It is not surprising that the heater unit without the blocks has a poorer performance, but it would also be expected that a heater unit with the blocks would have a poorer performance because, despite the presence of the blocks, a more frequent operation of the thermal cut-out device would be expected.

Figure 3:
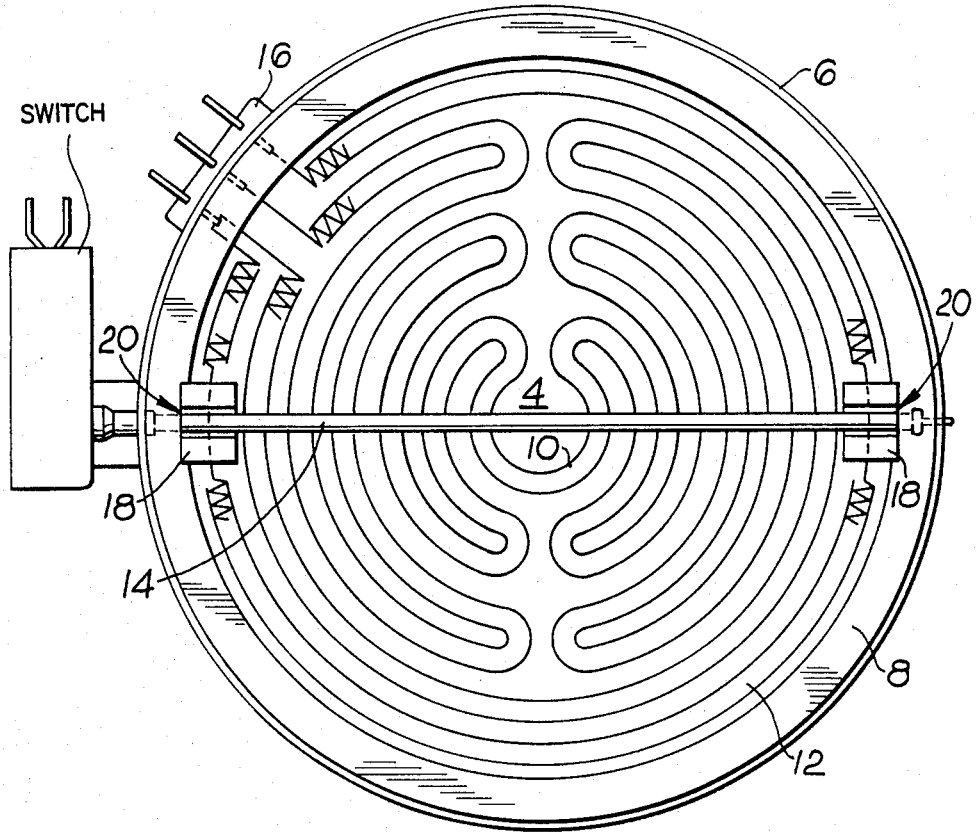
FIG. 3 is a plan view of a second embodiment of a radiant heater unit according to the present invention.
Figure 4:
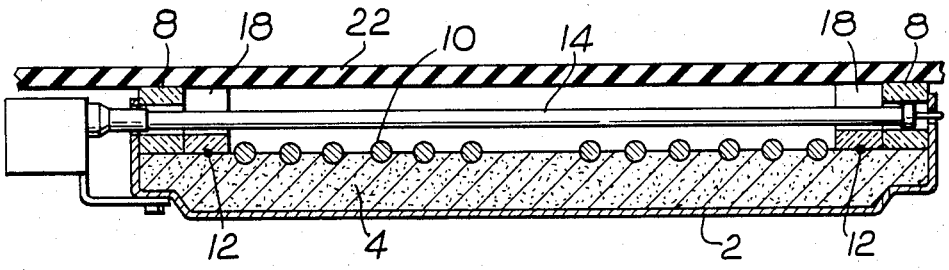
FIG. 4 is a sectional view showing the radiant heater unit of FIG. 3 arranged beneath the glass ceramic plate of a cooker.

The heater unit shown in FIGS. 3 and 4 is similar to that shown in FIGS. 1 and 2. However, the heater unit shown in FIGS. 3 and 4 has a nominal heated diameter of 180 mm. The inner heater element 10 is rated at 1500 watts and the outer heater element 12 is rated at 500 watts. The outer heater element is still confined to a single groove, but the inner heater element is now distributed over six concentric arcs.

Figure 5:
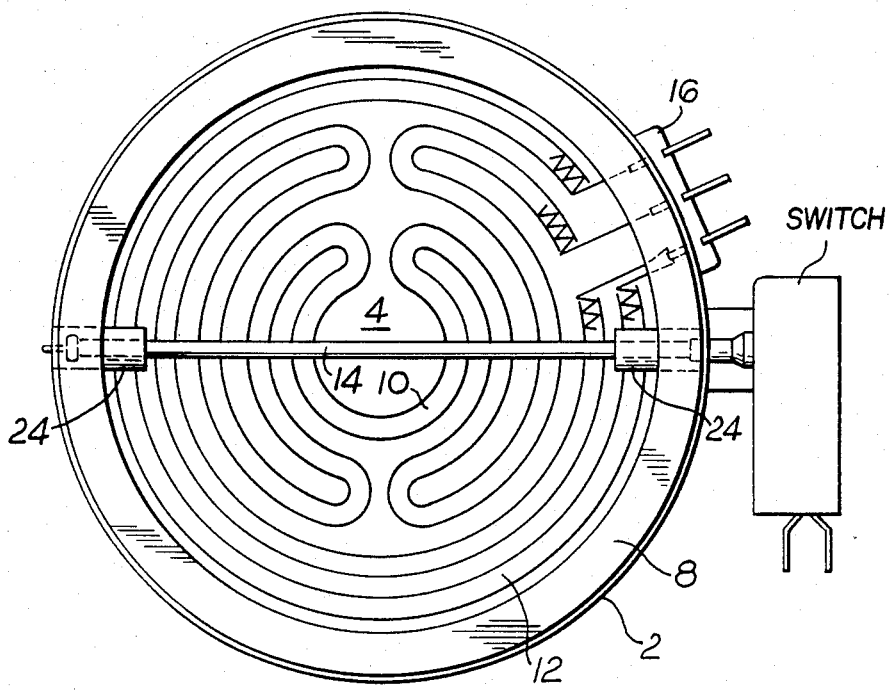
FIG. 5 is a plan view of a third embodiment of a radiant heater unit according to the present invention.

The heater unit shown in FIG. 5 is similar to that shown in FIGS. 1 and 2, but the blocks 18 have been replaced by copper tubes 24 which are secured to the metal dish 2 and which extend radially inwardly by a distance substantially the same as the blocks 18, that is to a point between the inner and outer heater elements.

While the illustrated embodiments of the invention all show the secondary heater element as the outer heater element, the secondary heater element may be arranged at any position within the heater unit as may be desired.

I claim:

1. An electric radiant heater unit for a glass ceramic top cooker, the heater unit comprising:

a base layer of electrical and thermal insulating material;

first and second bare heater elements disposed adjacent to each other on the base layer, said second heater element being disposed peripherally about said first heater element, said first and second heater elements being arranged such that, in use, heat emitted by the second heater element augments heat emitted by the first heater element;

a peripheral wall of thermal insulating material positioned on the base layer and surrounding the heater elements for keeping heat within the peripheral wall;

a thermal cut-out device for controllably disconnecting an electrical power source from the heater elements, the thermal cut-out device extending over the first and second heater elements; and means for minimizing heat conduction to the thermal cut-out device in regions thereof which pass over the second heater element from heat emitted by both the first and second heater elements.

2. A heater unit according to claim 1, wherein the minimizing means comprises a block of thermal insulating material.

3. A heater unit according to claim 2, wherein the block is made of ceramic fibre insulating material.

4. A heater unit according to claim 2, wherein the block is made of microporous insulating material.

5. A heater unit according to claim 2, wherein a groove is formed in the block for the thermal cut-out device.

6. A heater unit according to claim 5, wherein the block extends into a cut-away portion of the peripheral wall.

7. A heater unit according to claim 1, wherein the minimizing means comprises a heat sink for absorbing heat emitted by the first and second heater elements in the region of the second heater element and which conducts the heat outside the heater unit.

8. A heater unit according to claim 7, wherein the heat sink comprises a copper tube arranged at each end of the thermal cut-out device, the copper tubes each being connected to a metal dish which contains the base layer and the peripheral wall.

9. A heater unit according to claim 1, wherein the second heater element extends substantially entirely around the first heater element so as to be positioned between the first heater element and the peripheral wall.

10. A heater according to claim 1 and having a nominal heated diameter of 145 mm, wherein the first heater element is rated at 1000 watts and the second heater element is rated at 450 watts.

11. A heater unit according to claim 1 and having a nominal heated diameter of 180 mm, wherein the first heater element is rated at 1500 watts and the second heater element is rated at 500 watts.

* * * * *